US011794437B2

(12) United States Patent
Dai

(10) Patent No.: US 11,794,437 B2
(45) Date of Patent: Oct. 24, 2023

(54) PAPER BOX PACKAGE FORMING APPARATUS

(71) Applicant: JIANGSU BOSIDENG TECHNOLOGY CO., LTD., Suzhou (CN)

(72) Inventor: Jianguo Dai, Suzhou (CN)

(73) Assignee: JIANGSU BOSIDENG TECHNOLOGY CO., LTD., Jiangsu (CN)

( * ) Notice: Subject to any disclaimer, the term of this patent is extended or adjusted under 35 U.S.C. 154(b) by 0 days.

(21) Appl. No.: 17/779,562

(22) PCT Filed: Dec. 31, 2020

(86) PCT No.: PCT/CN2020/142184
§ 371 (c)(1),
(2) Date: May 25, 2022

(87) PCT Pub. No.: WO2022/099906
PCT Pub. Date: May 19, 2022

(65) Prior Publication Data

US 2023/0001664 A1 Jan. 5, 2023

(30) Foreign Application Priority Data

Nov. 13, 2020 (CN) ..... 202011266817.5

(51) Int. Cl.
*B31B 50/04* (2017.01)
*B31B 50/06* (2017.01)
(Continued)

(52) U.S. Cl.
CPC ..... *B31B 50/042* (2017.08); *B31B 50/006* (2017.08); *B31B 50/066* (2017.08);
(Continued)

(58) Field of Classification Search
CPC ... B31B 50/042; B31B 50/066; B31B 50/624; B31B 50/006; B31B 50/44;
(Continued)

(56) References Cited

U.S. PATENT DOCUMENTS 4,033,242 A * 7/1977 Rice ..... B31B 50/005 493/126
7,509,789 B2 * 3/2009 Scholtes ..... B31B 50/44 53/563

(Continued)

FOREIGN PATENT DOCUMENTS

CN 201702972 1/2011
CN 208068982 11/2018

(Continued)

OTHER PUBLICATIONS

"International Search Report (Form PCT/ISA/210) of PCT/CN2020/142184," dated Aug. 11, 2021, with English translation thereof, pp. 1-4.

(Continued)

*Primary Examiner* — Sameh Tawfik
(74) *Attorney, Agent, or Firm* — JCIP GLOBAL INC.

(57) ABSTRACT

A paper box package forming apparatus includes a continuous feeding device, a box folding mechanism and a cover sealing mechanism. The continuous feeding device includes a paperboard stacking frame, an adsorption mechanism and a roll extrusion conveying mechanism. A paperboard is absorbed from a back side of the paperboard stacking frame through the adsorption mechanism and conveyed to a box folding device through the roll extrusion conveying mechanism. The box folding device includes a downward-pressing inner punch, a box folding outer mold and a pushing mechanism. The pushing mechanism conveys a bottom box to the cover sealing mechanism. The downward-pressing and attaching mechanism includes downward-pressing driv- (Continued)

ing mechanism, a top-pressing plate, side-pressing plates and overturning cylinders. The side-pressing plates are hinged to side edges of the top-pressing plate through the driving of the overturning cylinders.

9 Claims, 10 Drawing Sheets

(51) Int. Cl.

| | |
|---|---|
| ***B31B 50/62*** | (2017.01) |
| ***B31B 50/00*** | (2017.01) |
| ***B31B 50/44*** | (2017.01) |
| *B31B 100/00* | (2017.01) |
| *B31B 110/35* | (2017.01) |
| *B31B 120/10* | (2017.01) |

(52) U.S. Cl.
CPC ..... *B31B 50/44* (2017.08); *B31B 50/624* (2017.08); *B31B 2100/0024* (2017.08); *B31B 2110/35* (2017.08); *B31B 2120/102* (2017.08)

(58) Field of Classification Search
CPC ..... B31B 2100/0024; B31B 2110/35; B31B 2120/102; B31B 50/04; B31B 50/06; B31B 50/26; B31B 50/40; B31B 50/782; B31B 2105/0024
USPC ..... 493/128
See application file for complete search history.

(56) References Cited

U.S. PATENT DOCUMENTS

| | | | | |
|---|---|---|---|---|
| 7,625,329 | B2 * | 12/2009 | Koehler | B65H 3/0808 493/131 |
| 8,647,247 | B2 * | 2/2014 | Pazdernik | B31B 50/30 493/175 |
| 8,696,535 | B2 * | 4/2014 | Vizanova Alzamora | B31B 50/00 493/51 |
| 2020/0171775 | A1 * | 6/2020 | Graham | B31B 50/006 |
| 2021/0323259 | A1 * | 10/2021 | Langen | B31B 50/72 |
| 2022/0194042 | A1 * | 6/2022 | Altamirano Paez | B31B 50/07 |

FOREIGN PATENT DOCUMENTS

| | | |
|---|---|---|
| CN | 109822967 | 5/2019 |
| CN | 111251656 | 6/2020 |
| CN | 111791538 | 10/2020 |
| WO | 2020146334 | 7/2020 |

OTHER PUBLICATIONS

"Written Opinion of the International Searching Authority (Form PCT/ISA/237) of PCT/ CN2020/142184," dated Aug. 11, 2021, pp. 1-4.

* cited by examiner

PAPER BOX PACKAGE FORMING APPARATUS

CROSS-REFERENCE TO RELATED APPLICATION

This application is a 371 of international application of PCT application serial no. PCT/CN2020/142184, filed on Dec. 31, 2020 which claims the priority benefit of China application no. 202011266817.5, filed on Nov. 13, 2020. The entirety of each of the above mentioned patent applications is hereby incorporated by reference herein and made a part of this specification.

TECHNICAL FIELD

The present invention relates to a paper box package forming apparatus, and belongs to the technical field of paper product manufacturing equipment.

DESCRIPTION OF RELATED ART

The paper box package forming apparatus is used for bending and adhering a paperboard to form a paper box. The paperboard is cut, rolled and folded in advance, and paperboards in a paperboard stack are conveyed to a bending station through a feeding device for folding. After the box is well folded, a product is put in the box followed by a cover sealing operation. At present, manual operation is usually used when a paper box with a turnover cover is folded and sealed, so that the labor intensity is high, and the improvement of production efficiency is not facilitated. In Chinese Patent Publication No. CN208068982U, the punching mechanism needs to comprise a bottom-forming outer mold assembly and an inner mold punch. The outer mold assembly comprises a limit baffle and a forming limit structure, the folding and forming of the bottom box need to be achieved by adhesion with glue, and it is difficult to ensure that the side walls of the paper box are sequentially folded and adhered when the bottom box is bent and formed, so that the forming yield is low. Only by pre-bending through other devices, can the paper box be completely formed by pre-folding the overlapped adhesion portion, which increases the complexity of the device, and simultaneously, the inner mold punch is easy to conflict with the pre-folded portion when being pressed downwards.

SUMMARY

Aiming at the above technical defects in the prior art, the present invention provides a paper box package forming apparatus to realize automatic box folding and automatic cover sealing operations of a paper box and thus to improve the production efficiency.

The technical solution of the present invention is as follows. A paper box package forming apparatus includes:

A continuous feeding device includes a paperboard stacking frame, an adsorption mechanism and a roll extrusion conveying mechanism. The paperboard stacking frame comprises a bottom frame, a back frame and side columns, the bottom frame is connected to the back frame at a right angle, the side columns are connected to the bottom frame and the back frame, the back frame is arranged obliquely, the back frame comprises a hollow frame and a block rod for blocking a paperboard from pulling out from a back side, and the block rod is arranged in an upper portion of the hollow frame. The adsorption mechanism is positioned on the back side of the back frame and comprises adsorption discs, an adjustable shelf and a pushing cylinder, a lower end of the adjustable shelf is hinged with a lower end of the back frame, the pushing cylinder is configured for pushing the adjustable shelf, and the adsorption discs are fixed to an upper portion of the adjustable shelf in a direction facing towards the back frame and is positioned below the block rod. The roll extrusion conveying mechanism is arranged above the back side of the back frame and comprises a lower conveyor belt and an upper roll extrusion belt, the upper roll extrusion belt is positioned above the lower conveyor belt, a conveying channel for conveying the paperboard is formed between the upper roll extrusion belt and the lower conveyor belt, and the lower conveyor belt is longer than the upper roll extrusion belt and forms a guide section for guiding the paperboard to enter the conveying channel at a position adjacent to the back frame.

A box folding device includes a machine frame, a downward-pressing inner punch, a box folding outer mold and a pushing mechanism. The downward-pressing inner punch is positioned above the box folding outer mold, and the downward-pressing inner punch is connected to the machine frame through a downward-pressing cylinder. The box folding outer mold comprises a front baffle, side baffles, back baffles, corner block rods and cover supporting rods, the front baffle, the side baffles and the back baffles are arranged in a rectangle side edge manner, a top edge height of the front baffle and the back baffles is higher than a top edge height of the side baffles, the corner block rods are each arranged at an opposite angle position of a corner formed by one of the back baffles and a respective one of the side baffles, a height of the corner block rods is higher than the top edge height of the back baffles, the cover supporting rods are arranged in parallel on two sides of the front baffle, a height of the cover supporting rods is higher than the top edge height of the front baffle, and the front baffle, the side baffles and the back baffles are connected to the machine frame through first horizontal cylinders. The pushing mechanism comprises a supporting table, pushing chains and pushing plates, the pushing plates are vertically connected to the pushing chains, the pushing chains are arranged on two sides of the supporting table, a height of the pushing chains is lower than a table top of the supporting table, and top edges of the pushing plates are higher than the table top of the supporting table.

A cover sealing mechanism includes a bearing table and a downward-pressing and attaching mechanism. The bearing table and the downward-pressing and attaching mechanism are connected to the machine frame, an in-place baffle is arranged on the bearing table, the downward-pressing and attaching mechanism is arranged above the bearing table and comprises a downward-pressing driving mechanism, a top-pressing plate, side-pressing plates and overturning cylinders, the top-pressing plate is connected to the machine frame through the downward-pressing driving mechanism, the top-pressing plate is rectangular, four side edges of a periphery of the top-pressing plate are hinged with the side-pressing plates, the overturning cylinders are fixedly connected to a top surface of the top-pressing plate, and the overturning cylinders drive the side-pressing plates to overturn downwards.

The roll extrusion conveying mechanism is positioned on one side of the downward-pressing inner punch and the box folding outer mold, the paperboard output by the roll extrusion conveying mechanism enters a space between the downward-pressing inner punch and the box folding outer mold, and a paper box is pushed to the bearing table by the pushing mechanism.

In order to make the paperboard more easily absorbed from a paperboard stack and pulled out from the back frame, furthermore, rollers are arranged on the block rod.

In order to enable the paperboard to enter the conveying channel more smoothly according to the shape of the lower conveyor belt after being adsorbed, furthermore, a guide rod is arranged in a lower portion of the hollow frame, and guide rollers are arranged on the guide rod.

In order to keep the paperboard of the paperboard stack to be always attached to the back frame, furthermore, a plurality of guide posts are arranged on the bottom frame, and a sliding press plate is arranged on the guide posts. The paperboard can be always close to the back frame by utilizing the sliding of the sliding press plate and the self gravity of the paperboard.

Furthermore, the corner block rods are each positioned at a position of an included angle within 20° of a bisector of angle formed by one of the back baffles and the respective one of the side baffles.

Furthermore, a horizontal contact portion is arranged on each of the corner block rods, and an angle of less than 90° is formed between a vertical projection of the horizontal contact portion and a vertical projection of the back baffle or the side baffle.

Furthermore, in order to ensure reliable adhesion, the downward-pressing inner punch comprises a bottom plate and side walls. The side walls are connected to the bottom plate through second horizontal cylinders, the side walls are positioned on the upper side of the bottom plate, and the bottom plate is connected to the downward-pressing cylinder.

Furthermore, in order to enable the relative positions of the paper sheet conveyed by the feeding mechanism and the downward-pressing inner punch and the box folding outer mold to be more accurate, guide plates are arranged above the box folding outer mold, and the guide plates are connected to the machine frame through third horizontal cylinders.

Furthermore, in order to ensure complete adhesion of the box cover and the bottom box of the paper box, downward-hanging roll extrusion wheels are arranged on side edges of the top-pressing plate, and notches are arranged on the side-pressing plates and configured for enabling the roll extrusion wheels to pass therethrough.

Furthermore, in order to adapt to covers of paper boxes with different heights, a bottom surface of the top-pressing plate is connected to a second press plate in a hanging manner through springs, and a vertical projection of the second press plate is within a vertical projection range of the top-pressing plate.

Compared with the prior art, the present invention has the following advantages.

There is no need to additionally add a driving unit to bend ear portions used for adhesion alone, and independently perform bending time control on different positions of the paper box, as the bottom box of the paper box can be folded and adhered as required only by one downward-pressing step of the downward-pressing inner punch, thereby improving the product yield of paper boxes, and also ensuring that the forming structure of paper boxes can meet the requirement of subsequent cover sealing operations.

After the bottom box of the paper box is folded and adhered, the bending of both sides of the box cover is completed when the paper box is conveyed forward, and an end surface of the box cover is bent and attached through an end portion attaching mechanism, so that the manual operation is omitted, and the production efficiency is improved. Both sides of the cover plate of the paper box are naturally bent through the matching of the paper box pushing mechanism and the bending guide rod, and a cylinder-pushing-type bending mechanism is not adopted, so that a control assembly is reduced, the structure of the device is simplified, and the control mode is simple. The paper box has few steps of cover sealing and high box forming efficiency.

DESCRIPTION OF THE EMBODIMENTS

The present invention is further described below with reference to the embodiments which should not be construed as limitations of the present invention.

Figure 1:
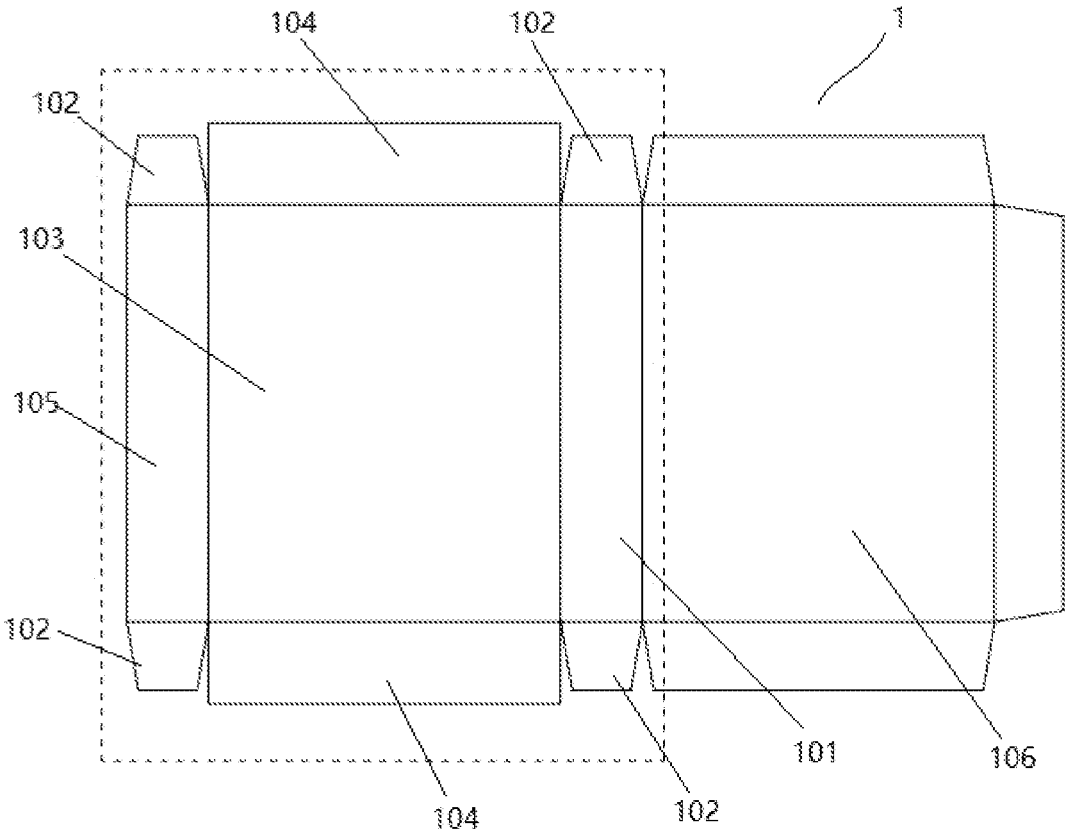
FIG. 1 is a flat-plate-shaped paper sheet structure prior to paper box formation.

For better understanding of the present invention, as shown in FIG. 1, the left side of a flat-plate-shaped paper sheet 1 is configured for forming a bottom box, the foremost end of the left side is a front side wall 101, the upper and lower ends of the front side wall 101 are ear portions 102 for adhesion, the front side wall 101 is connected to the front side of a box bottom plate 103, and the front side of the front side wall 101 is connected to a box cover 106. The upper and lower sides of the box bottom plate 103 are connected to left and right side walls 104, and the rear side of the box bottom plate 103 is connected to a rear side wall 105. The upper and lower ends of the rear side wall 105 are also ear portions 102 for adhesion. The ear portions 102 of the front side wall 101 and the rear side wall 105 need to be folded to the inner sides of the left and right side walls 104 to be adhered to the left and right side walls 104. However, the present invention can complete the forming of the bottom box by pressing downward in one step, and then complete the sealing of the box cover 106 to cover the bottom box by the cover sealing mechanism.

Figure 2:
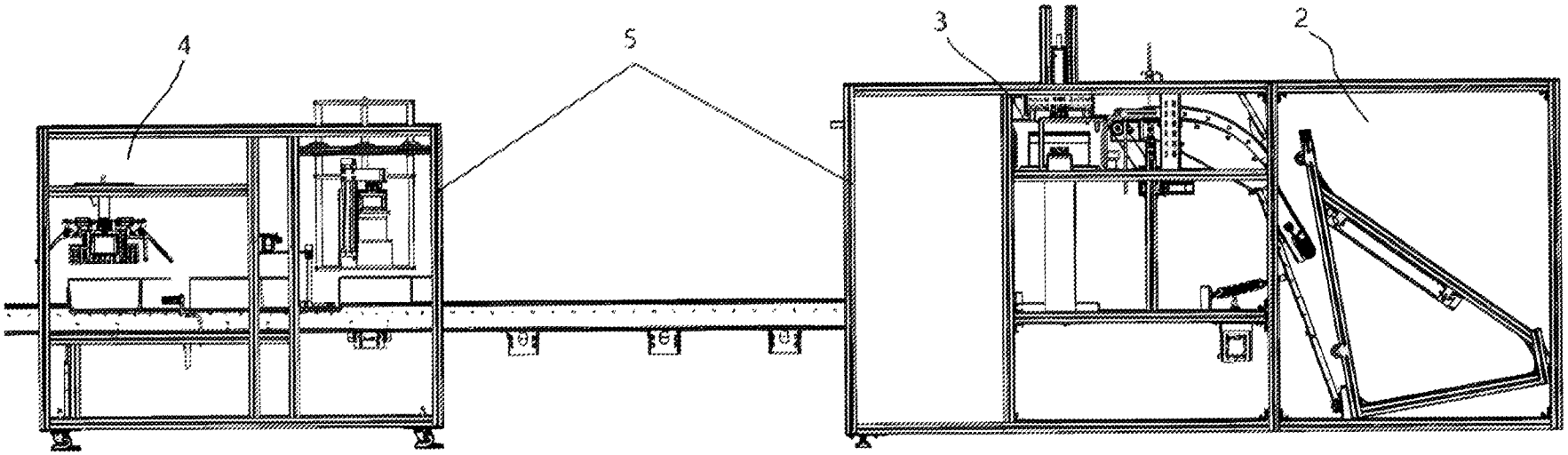
FIG. 2 is a schematic diagram of the structure of the paper box package forming apparatus.

As shown in FIG. 2, the paper box package forming apparatus comprises a continuous feeding device 2, a box folding mechanism 3 and a cover sealing mechanism 4. The continuous feeding device continuously provides flat-plate-shaped paper sheets 1 for the box folding mechanism, the box folding mechanism 3 completes folding and adhesion of the bottom box, and then the bottom box is conveyed to the cover sealing mechanism 4 to perform sealing and adhesion of the box cover 106 after an object to be loaded falls down to the bottom box.

Figure 3:
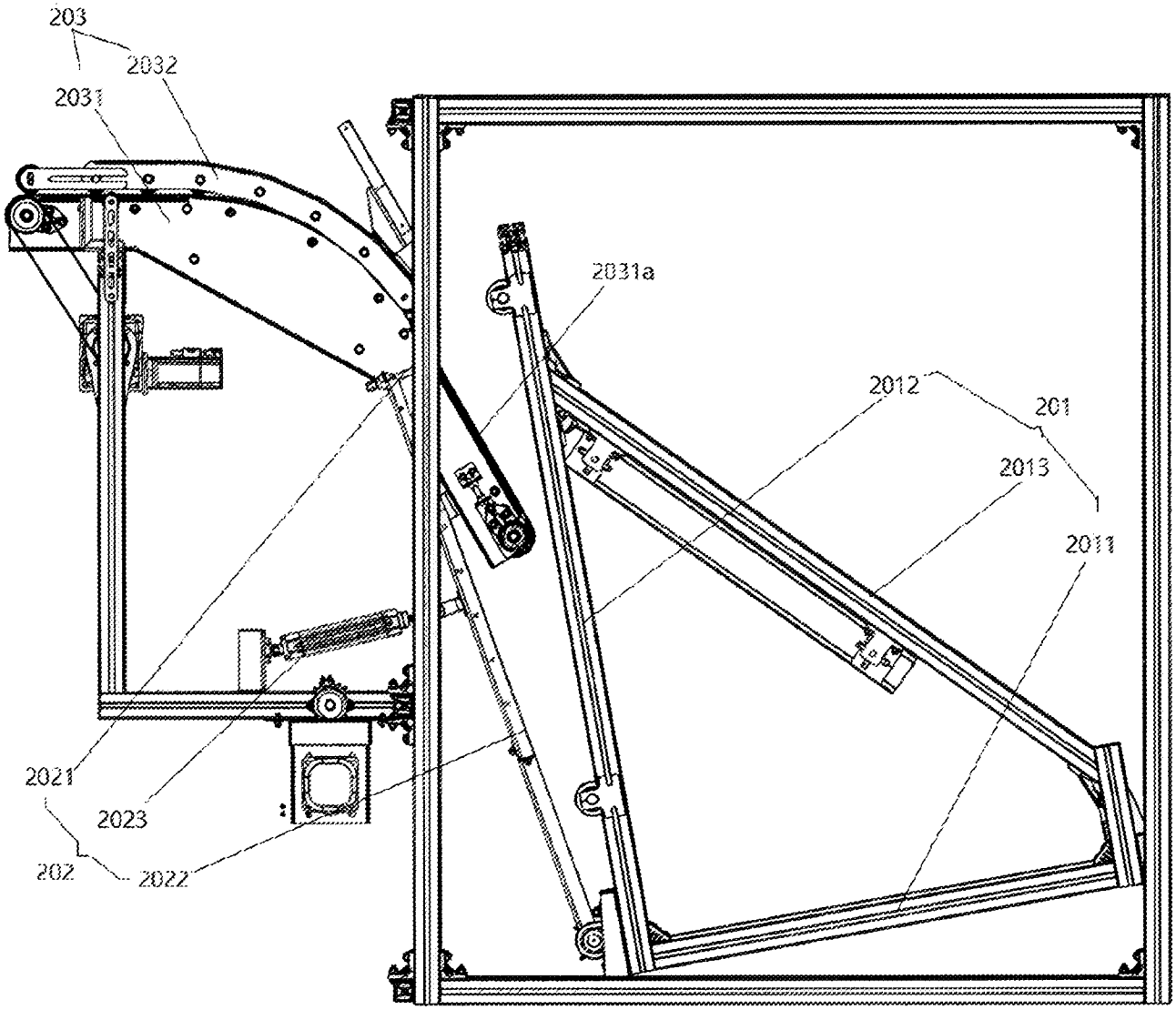
FIG. 3 is a schematic diagram of the structure of the continuous feeding device.
Figure 4:
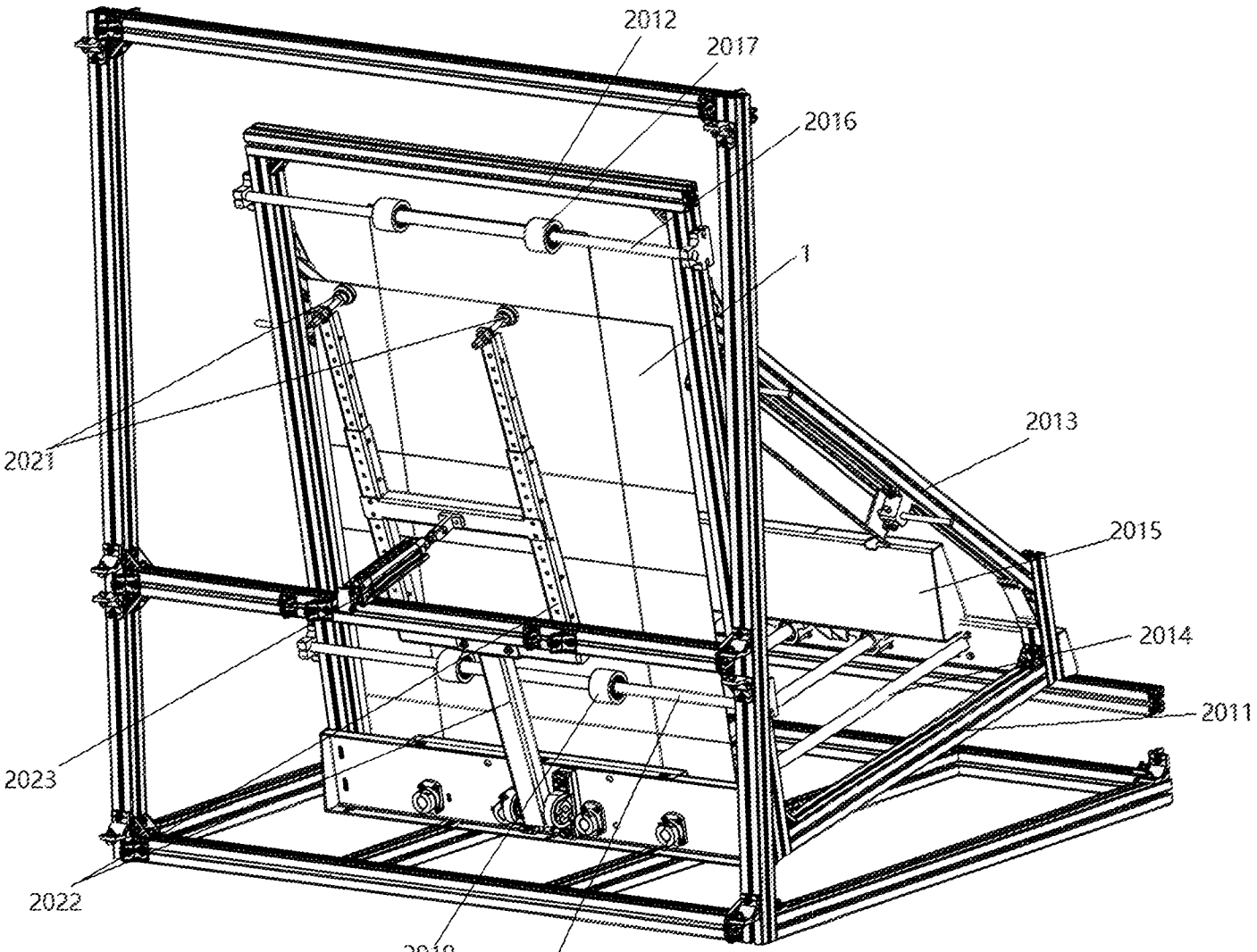
FIG. 4 is a schematic diagram of the structure of the back side of the continuous feeding device.
Figure 5:
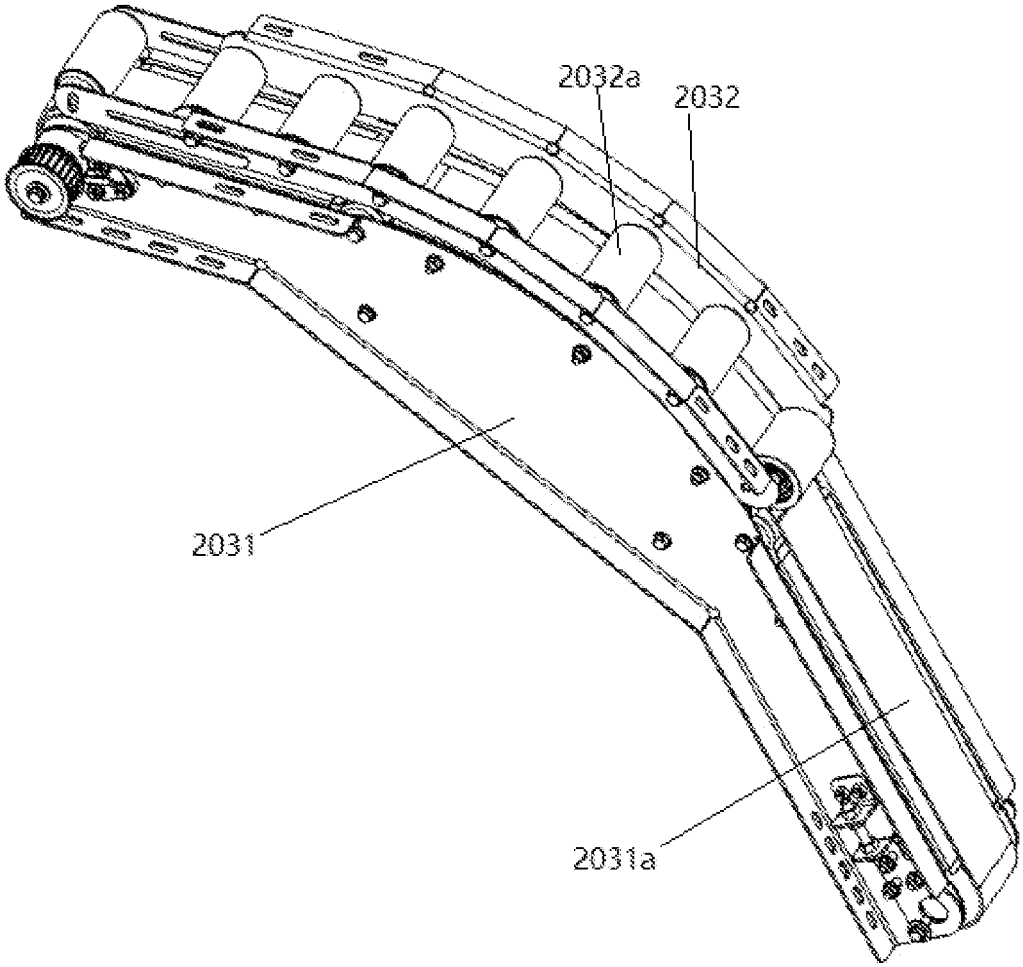
FIG. 5 is a schematic diagram of the structure of the roll extrusion conveying mechanism.

As shown in FIG. 3, FIG. 4 and FIG. 5, the continuous feeding device 2 comprises a paperboard stacking frame 201, an absorption mechanism 202 and a roll extrusion conveying mechanism 203. The paperboard stacking frame 201 is formed by connecting a bottom frame 2011, a back frame 2012 and side columns 2013. The bottom frame 2011 is connected to the back frame 2012 at a right angle, and the two side columns 2013 are positioned on two sides of the bottom frame 2011 and the back frame 2012 and are connected to the bottom frame 2011 and the back frame 2012, respectively. A plurality of guide posts 2014 perpendicular to a connecting edge of the bottom frame 2011 and the back frame 2012 are arranged on the bottom frame 2011, and a sliding press plate 2015 is arranged on the guide posts 2014. The sliding press plate 2015 can slide along the guide posts 2014. The back frame 2012 is arranged obliquely slightly, so that a side of the bottom frame 2011 connected with the back frame 2012 is lower, and the other side of the bottom frame 2011 far away from the back frame 2012 is higher. The cut and pre-folded flat-plate-shaped paper sheet 1 is placed in the paperboard stacking frame 201 parallel to the back frame 2012. The sliding press plate 2015 presses the bottom surface of the flat-plate-shaped paper sheet 1 to the back frame 2012 due to the action of gravity. The overall height of the back frame 2012 is higher than the overall height of the flat-plate-shaped paper sheet 1, the periphery of the back frame 2012 is a hollow frame, a transverse block rod 2016 is arranged in the middle upper portion of the hollow frame, and a distance between the block rod 2016 and the bottom of the back frame 2012 is slightly lower than the height of the flat-plate-shaped paper sheet 1, so that the flat-plate-shaped paper sheet 1 can be limited within the paperboard stacking frame 201 by the block rod 2016 and the bottom of the back frame 2012 in a flatten state.

In order to easily absorb the flat-plate-shaped paper sheet 1 out of the paperboard stacking frame 201, rollers 2017 are arranged on the block rod 2016, and the flat-plate-shaped paper sheet 1 can be taken out of the back side of the back frame 2012 by slightly bending with the aid of the rolling of the rollers 2017. Meanwhile, in order to make the flat-plate-shaped paper sheet 1 easily bent during the absorption and more easily conveyed to the roll extrusion conveying mechanism 203, a transverse guide rod 2018 is arranged in the middle lower portion of the hollow frame, and guide rollers 2019 are arranged on the guide rod 2018. When the adsorption mechanism 2 adsorbs the flat-plate-shaped paper sheet 1 from the back side and pulls the flat-plate-shaped paper sheet backward, the top end of the flat-plate-shaped paper sheet 1 can be pulled out from the position of the rollers 2017 of the block rod 2016, and the flat-plate-shaped paper sheet 1 forms a bending point at the position of the guide rollers 2019.

The adsorption mechanism 202 is positioned on the back side of the back frame 2012, and the adsorption mechanism 202 comprises adsorption discs 2021, an adjustable shelf 2022 and a pushing cylinder 2023. The lower end of the adjustable shelf 2022 is hinged with the lower end of the back frame 2012, the pushing cylinder 2023 is configured for pushing the adjustable shelf 2022, the adsorption discs 2021 are fixed to the upper portion of the adjustable shelf 2022 in a direction facing towards the back frame 2012, and the height of the adsorption discs 2021 is lower than the height of the block rod 2016 so that the adsorption discs can be adsorbed on the surface of the flat-plate-shaped paper sheet 1. After the pushing cylinder 2023 pushes the adjustable shelf 2022 to approach the back frame 2012, the adsorption discs 2021 is adsorbed on the surface of the flat-plate-shaped paper sheet 1, then the pushing cylinder 2023 retracts, and the adsorption discs 2021 pulls out the top of the flat-plate-shaped paper sheet 1.

The roll extrusion conveying mechanism 203 is arranged above the back side of the back frame 2012, and the roll extrusion conveying mechanism 203 comprises a lower conveyor belt 31 and an upper roll extrusion belt 2032. The lower conveyor belt 2031 is driven by a motor. The upper roll extrusion belt 2032 is positioned above the lower conveyor belt 2031, and the upper roll extrusion belt 2032 is formed by a plurality of rolling columns 2032*a* arranged at intervals along the conveying direction of the lower conveyor belt 2031. A conveying channel for conveying the flat-plate-shaped paper sheet 1 is formed between the upper roll extrusion belt 2032 and the lower conveyor belt 2031, and the lower conveyor belt 2031 is longer than the upper roll extrusion belt 2042 and forms a guide section 2031*a* for guiding the flat-plate-shaped paper sheet 1 into the conveying channel at a position close to the back frame 2012. The guide section 2031*a* is at a lower position such that the adsorption discs 2021 are positioned on both sides of the guide section 2031*a*, and the height of the adsorption discs 2021 is higher than the front end of the guide section 2031*a*. Therefore, the flat-plate-shaped paper sheet 1 pulled out from the adsorption discs 2021 can directly lean on the lower conveyor belt 2031, so that the flat-plate-shaped paper sheet 1 can be pulled by the lower conveyor belt 2031 through friction force, and the lower end of the flat-plate-shaped paper sheet 1 is pulled out from the back frame 2012, and meanwhile, the top end of the flat-plate-shaped paper sheet 1 is conveyed to the conveying channel. The conveying channel of the flat-plate-shaped paper sheet 1 formed by the whole roll extrusion conveying mechanism 203 is slightly inclined from the vertical direction to the horizontal direction, so that the flat-plate-shaped paper sheet 1 is finally conveyed to the box folding mechanism 3 in a horizontal manner for a subsequent forming step.

Figure 6:
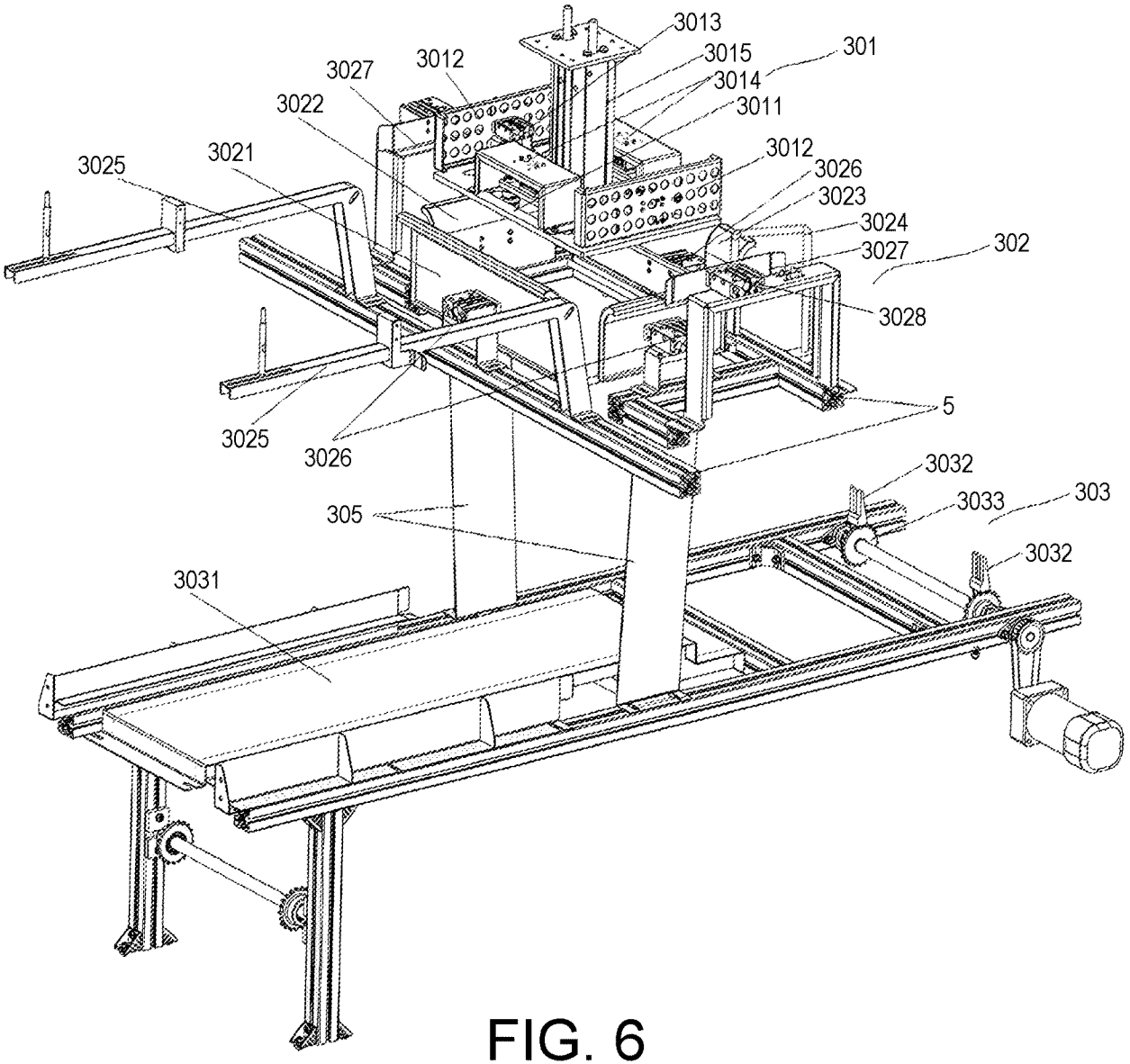
FIG. 6 is a schematic diagram of the structure of the box folding mechanism.

As shown in FIG. 6, the box folding mechanism of the paper box package forming apparatus comprises a downward-pressing inner punch 301, a box folding outer mold 302, a pushing mechanism 303 and a machine frame 5. The downward-pressing inner punch 301 is positioned above the box folding outer mold 302, the downward-pressing inner punch 301 is configured for pressing the flat-plate-shaped paper sheet 1 downward into the box folding outer mold 302, and the downward-pressing inner punch 301 comprises a bottom plate 3011 and side walls 3012. The side walls 3012 are positioned on the bottom plate 3011 and on the left and right sides of the bottom plate 3011, the side walls 3012 are connected with the bottom plate 3011 through second horizontal cylinders 3013, stoppers 3014 are arranged on front and rear sides of the bottom plate 3011, respectively, the bottom plate 3011 is connected with the machine frame 5 (a portion of the machine frame 5 is not shown in FIG. 6) through a downward-pressing cylinder 3015, and the machine frame 5 is also configured for fixing the continuous feeding device 2 and the cover sealing mechanism 4. The downward-pressing cylinder 3015 drives the downward-pressing inner punch 301 to move up and down to be matched with the box folding outer mold 302 to perform a box folding operation. The roll extrusion conveying mechanism 203 is positioned on one side of the downward-pressing inner punch 301 and the box folding outer mold 302, and the flat-plate-shaped paper sheet 1 output by the roll extrusion conveying mechanism 203 enters a space between the downward-pressing inner punch 301 and the box folding outer mold 302.

Figure 7:
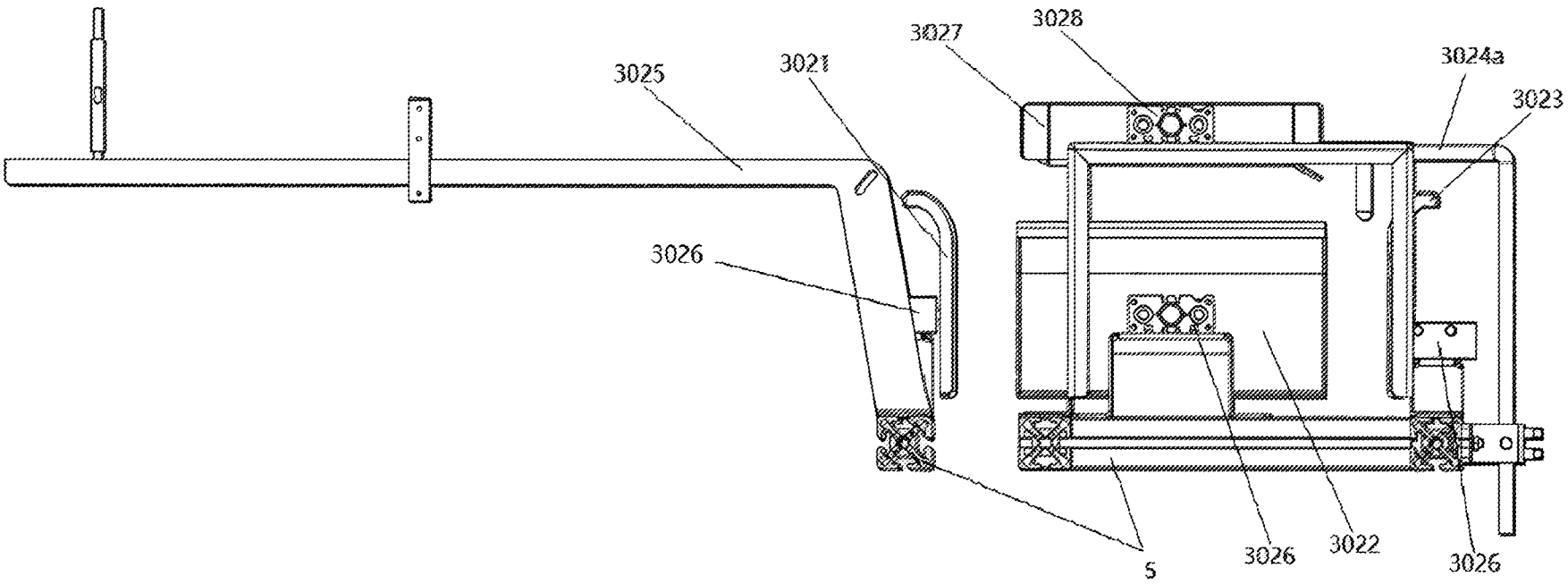
FIG. 7 is a side view of the structure of the box folding outer mold.
Figure 8:
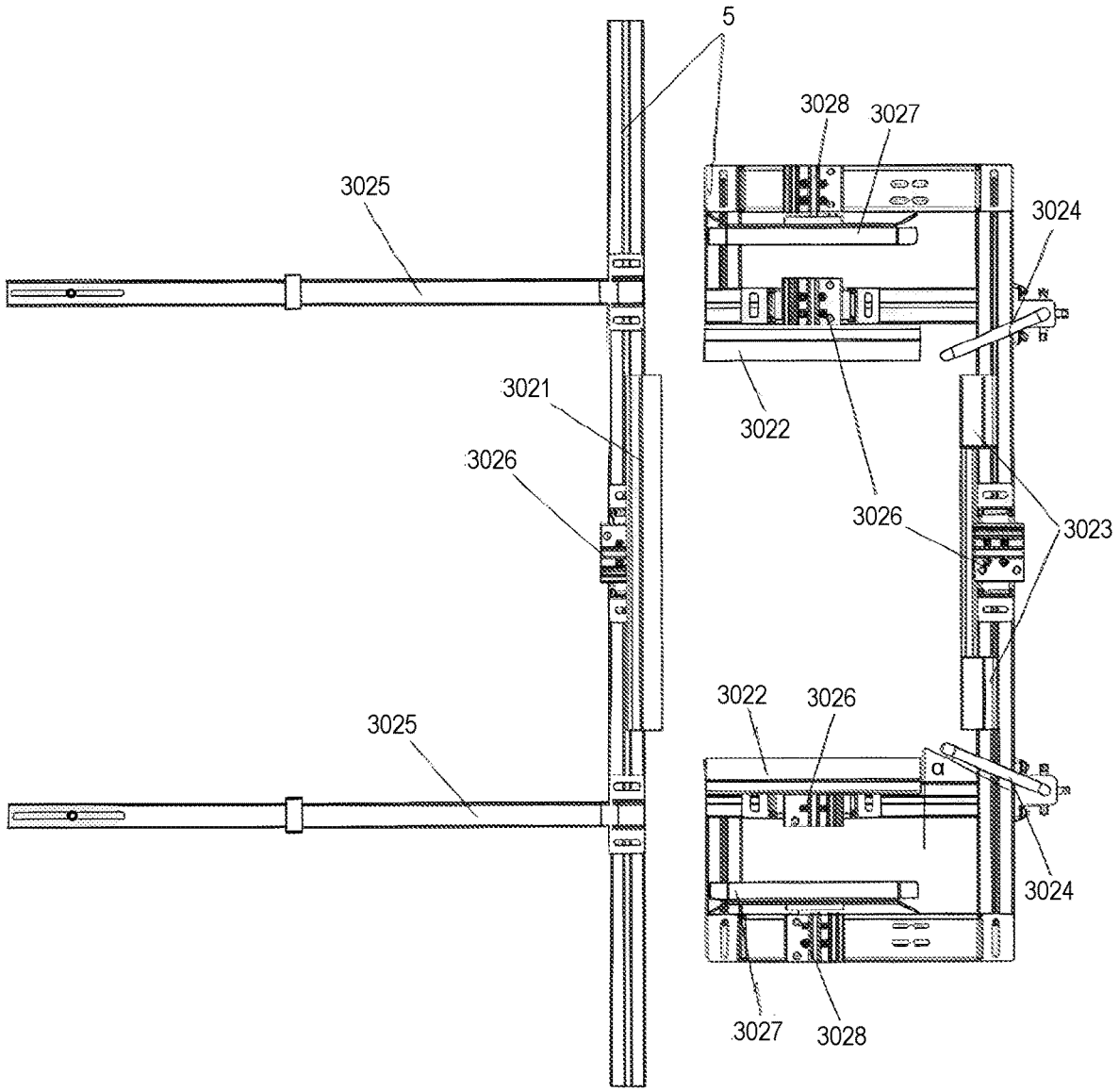
FIG. 8 is a top view of the structure of the box folding outer mold.

As shown in FIG. 7 and FIG. 8, the box folding outer mold 302 comprises a front baffle 3021, side baffles 3022, back baffles 3023, corner block rods 3024 and cover supporting rods 3025. The front baffle 3021, two side baffles 3022 and the back baffles 3023 are arranged in a rectangle side edge manner. In the process of pressing downward the flat-plate-shaped paper sheet 1, the box bottom plate 103 is pressed into a rectangle surrounded by the front baffle 3021, the side baffles 3022 and the back baffles 3023. The front baffle 3021 and the back baffles 3023 may be arranged with the same height, but the top edge height of the front baffle 3021 and the back baffles 3023 is higher than the top edge height of the side baffles 3022, so that the front side wall 101 and the rear side wall 105 of the flat-plate-shaped paper sheet 1 are bent before the left and right side walls 104 by being in contact with the box folding outer mold 302 during the downward-pressing process. The front baffle 3021, the side baffles 3022 and the back baffles 3023 are connected with the machine frame 5 through first horizontal cylinders 3026, and when the first horizontal cylinders 3026 are actuated, the size of the rectangle surrounded by the front baffle 3021, the side baffles 3022 and the back baffles 3023 is increased or decreased accordingly. When the flat-plate-shaped paper sheet 1 is pressed into the rectangular space surrounded by the front baffle 3021, the side baffles 3022 and the back baffles 3023, the first horizontal cylinders 3026 are actuated to decrease the rectangular space, and at this point, the second horizontal cylinders 3013 combined with the downward-pressing inner punch 301 are actuated to expand the side walls 3012, thereby making the adhesion of the two sides of the paper box more reliable.

Corner block rods 3024 are each arranged at an opposite angle position of a corner formed by the back baffle 3023 and the side baffle 3022. Corner block rods 3024 are each positioned at a position of an included angle within 20° of a bisector of angle formed by the back baffle 3023 and the side baffle 3022. The corner block rods 3024 are configured for putting stress on the ear portions 102 of the rear side wall 105 to be folded first, so that the overall position of the corner block rods 3024 is outside the rectangle 4 surrounded by the front baffle 3021, the side baffles 3022 and the back baffles 3023, and the height of the corner block rods 3024 is higher than the top edge height of the back baffles 3023. The two cover supporting rods 3025 are arranged on two sides of the front baffle 3021 and extend in the front-rear direction, and the height of the cover supporting rods is higher than the top edge height of the front baffle 3021. The cover supporting rods 3025 are configured for supporting the box cover 106 of the flat-plate-shaped paper sheet 1 to prevent the flat-plate-shaped paper sheet 1 from falling down when the flat-plate-shaped paper sheet 1 is conveyed to the downward-pressing inner punch 301 through the feeding mechanism, and for allowing the ear portions 102 of the front side wall 101 to be folded under stress first.

In this embodiment, the corner block rods 3024 are of an inverted "J" shape, the tops of the corner block rods 3024, i.e., the bottoms of the "J" shaped hooks, are horizontal contact portions 3024*a* horizontally arranged, and the head ends of the horizontal contact portions 3024*a* are bent downward to form circular arcs with a small radius, so that the contact portions between the corner block rods 3024 and the paper sheet are relatively smooth, and the paper sheet can be prevented from being damaged. An angle $\alpha$ between a vertical projection of the horizontal contact portion 3024*a* and a vertical projection of the back baffle 3023 or the side baffle 3022 is less than 90°, so that the contact surfaces between the horizontal contact portions 3024*a* and the ear portions 102 of the flat-plate-shaped paper sheet 1 are ensured to be long enough to ensure the bending of the ear portions 102. In order to make the paper box more smoothly enter when folded, the top edges of the front baffle 3021, the back baffles 3023 and the side baffles 3022 are folded to the outside of the rectangle to form an expanded shape. In order to ensure the relative positions of the paper sheet conveyed by the feeding mechanism and the downward-pressing inner punch 301 and the box folding outer mold 302 to be more accurate, guide plates 3027 are further arranged above the box folding outer mold 302 and positioned on the two sides of the downward-pressing inner punch 301, and the guide plates 3027 are connected to the machine frame 5 through third horizontal cylinders 3028. When the flat-plate-shaped paper sheet 1 is conveyed by the feeding mechanism, the guide plates 3027 are driven by the third horizontal cylinders 3028 to move toward the center by a small distance such that a distance between the two guide plates 3027 corresponds to the width of the flat-plate-shaped paper sheet 1, and when the downward-pressing inner punch 301 is pressed downward, the guide plates 3027 are driven by the third horizontal cylinders 3028 to move toward the two sides for resetting.

The pushing mechanism 303 is arranged below the box folding outer mold 302, and the adhered paper box is pushed to the next station by the pushing mechanism 303. The pushing mechanism 303 comprises a supporting table 3031, pushing chains (not directly shown in FIG. 7 and FIG. 8) and pushing plates 3032. The pushing chains are driven by chain wheels 3033 and arranged on two sides of the supporting table 3031, and the height of the pushing chains is lower than a table top of the supporting table 3031. The pushing plates 3032 are vertically connected to the pushing chains, and the top edge of the pushing plates 3032 is higher than the table top of the supporting table 3031. In order to avoid its deviation from the supporting table 3031 when the paper box falls down, lateral guide plates 305 are arranged on two sides of the supporting table 3031 between the box folding outer mold 302 and the pushing mechanism 303. After the paper box is folded and adhered, the first horizontal cylinders 3026 of the box folding outer mold 302 are actuated to expand the rectangular space, so that the paper box can fall from the box folding outer mold 302 to the table top of the supporting table 3031, and then the pushing chains drive the pushing plates 3032 to move forward, and the paper box is pushed by the pushing plates 3032 to move forward to the next station along the table top of the supporting table 3031.

Figure 9:
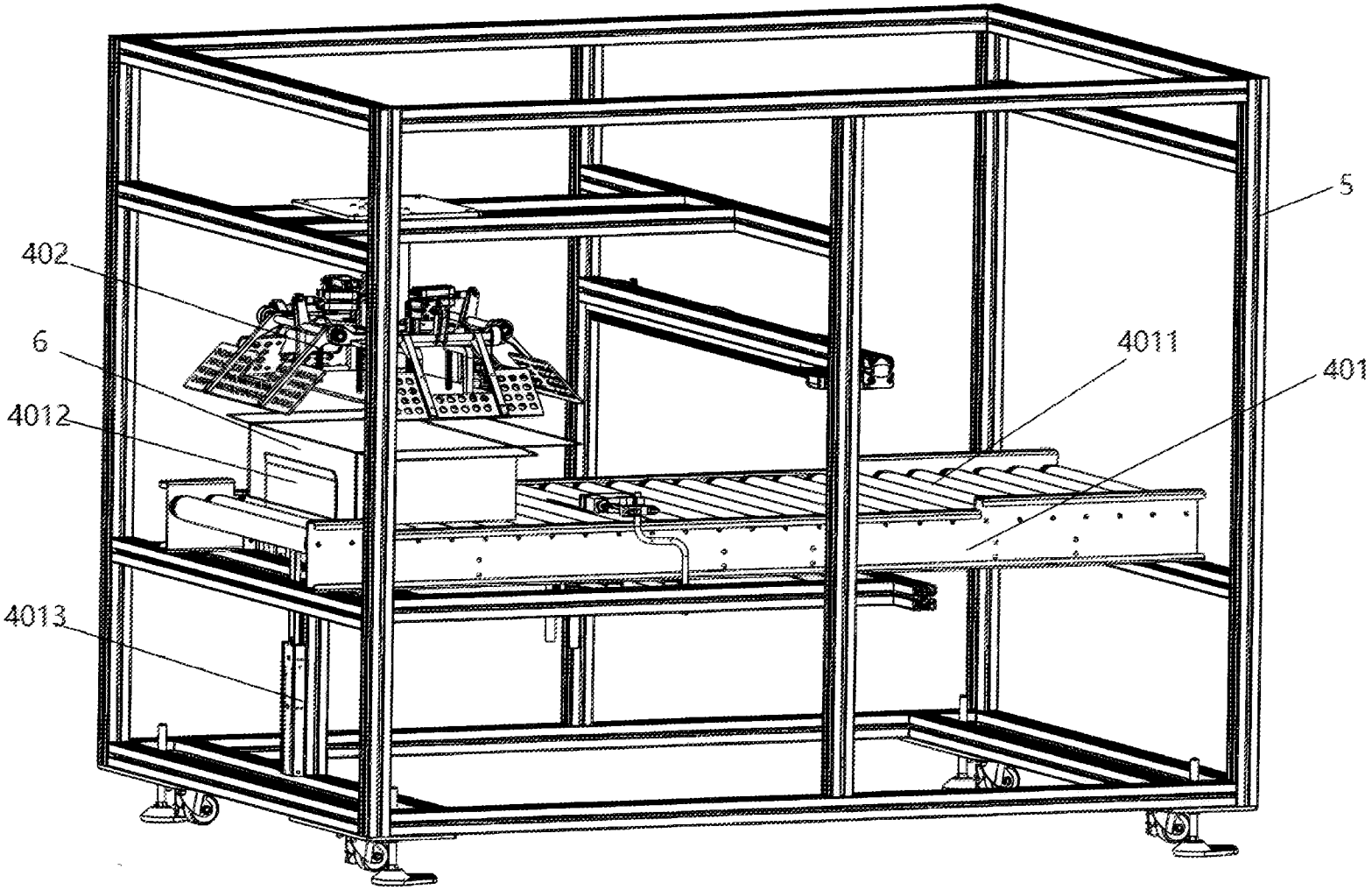
FIG. 9 is a schematic diagram of the structure of the cover sealing mechanism.
Figure 10:
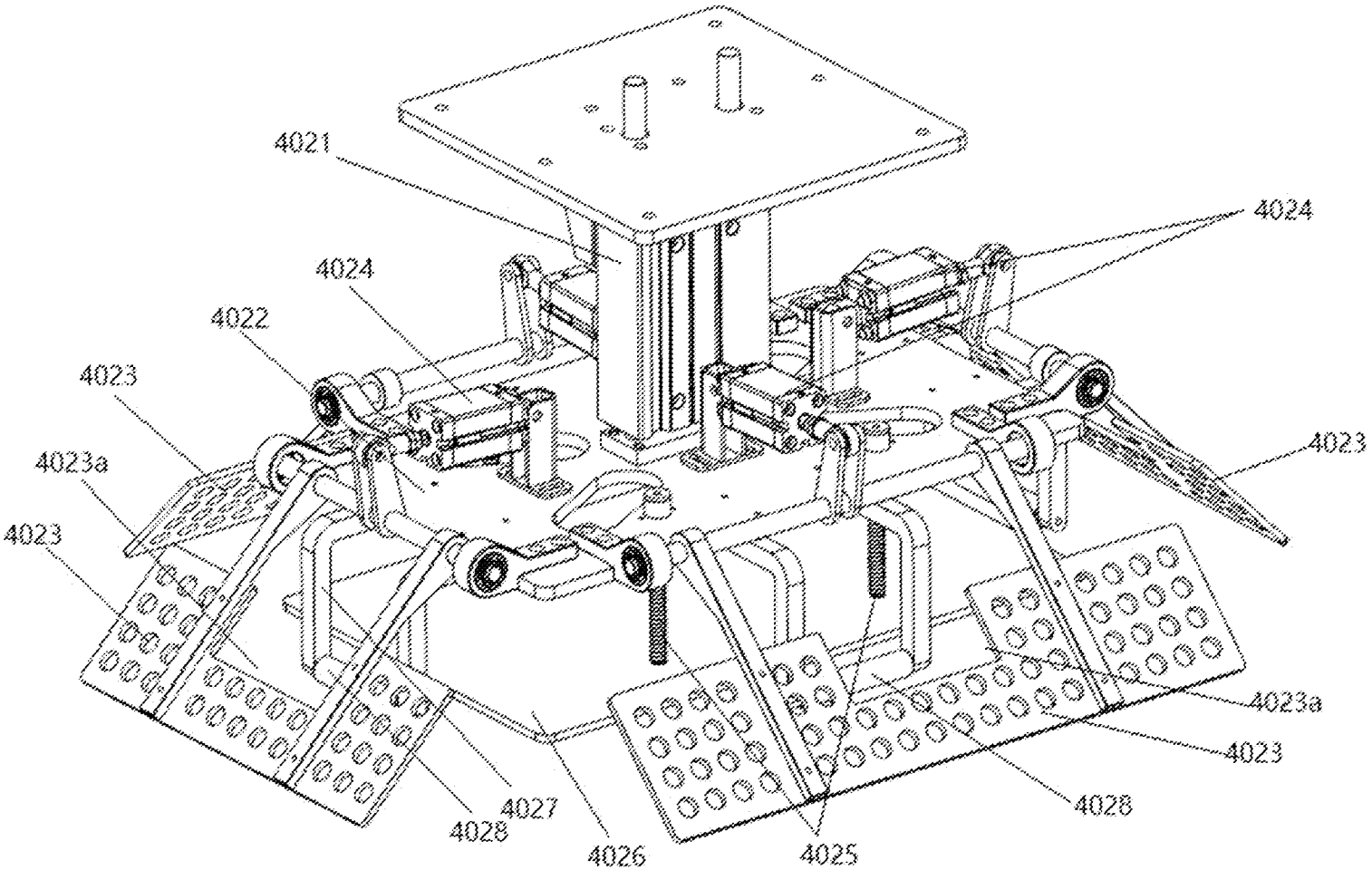
FIG. 10 is a schematic diagram of the structure of the downward-pressing and attaching mechanism.

As shown in FIG. 9 and FIG. 10, the cover sealing mechanism 4 of the paper box package forming apparatus comprises a bearing table 401 and a downward-pressing and attaching mechanism 402. The bearing table 401 and the downward-pressing and attaching mechanism 402 are connected to the machine frame 5. A row of rollers 4011 are arranged on the surface of the bearing table 401 to drive the paper box 6 to move on the surface of the bearing table 401 so that the paper box 6 moves to a position directly below the downward-pressing and attaching mechanism 402. An in-place baffle 4012 is arranged on the bearing table 401, a lifting cylinder 4013 is arranged below the bearing table 401, and the lifting cylinder 4013 is configured for driving the in-place baffle 4012 to rise and fall. When the paper box 6 moves on the bearing table 401, the lifting cylinder 4013 drives the in-place baffle 4012 to rise, so that the paper box 6 can be blocked from continuing to move forward. The in-place baffle 4012 is arranged below the downward-pressing and attaching mechanism 402, so that the paper box 6 can be subjected to a cover sealing operation when moving at a position directly below the downward-pressing and attaching mechanism 402.

The downward-pressing and attaching mechanism 402 is arranged above the bearing table 401. The downward-pressing and attaching mechanism 402 comprises a downward-pressing driving mechanism 4021, a top-pressing plate 4022, side-pressing plates 4023 and overturning cylinders 4024. The top-pressing plate 4022 is connected to the machine frame 5 through the downward-pressing driving mechanism 4021, and the downward-pressing driving mechanism 4021 can be a linear servo mechanism or a cylinder. The top-pressing plate 4022 is arranged in a rectangular shape, a bottom surface of the top-pressing plate 4022 is connected to a second press plate 4026 in a hanging manner through springs 4025, and a vertical projection of the second press plate 4026 is within a vertical projection range of the top-pressing plate 4022. The four side edges of the periphery of the top-pressing plate 4022 are hinged with the side-pressing plates 4023, the overturning cylinders 4024 are fixedly connected to a top surface of the top-pressing plate 4022, and the overturning cylinders 4024 drive the side-pressing plates 4023 to overturn downwards. Downward-hanging brackets 4027 are arranged on side edges of the top-pressing plate 4022, roll extrusion wheels 4028 are arranged on the downward-hanging brackets 4027, and notches 4023*a* are arranged on the side-pressing plates 4023 and configured for enabling the roll extrusion wheels 4028 to pass through.

When the paper box 6 is positioned directly below the downward-pressing and attaching mechanism 402, the downward-pressing driving mechanism 4021 drives the top-pressing plate 4022 to fall, and then the second press plate 4026 is in contact with the box cover and compresses the springs 4025. A falling distance of the top-pressing plate 4022 is fixed when the height of the paper box 6 is uneven, and the second press plate 4026 can compress the springs 4025 to different degrees to ensure that the box cover is well adhered to the bottom box of the paper box 6. In the process of falling the top-pressing plate 4022, the roll extrusion wheels 4028 firstly make the edge portions of the box cover adhered to the side wall portions of the bottom box of the paper box 6, the side-pressing plates 4023 are driven to overturn downwards through the overturning cylinders 4024 after the top-pressing plate 4022 is in place, and the side-pressing plates 4023 are turned into a vertical state from an initial horizontal or slightly inclined state, so that the edge portions of the box cover are adhered to the side walls of the bottom box of the paper box 6.

It should be noted that, before the box folding mechanism 3 and the cover sealing mechanism 4 are actuated, the gluing process needs to be performed on the portions of the bottom box and the box cover 106 of the paper box which need to be adhered, and accordingly, gluing nozzles can be arranged in front of the box folding mechanism 3 and the cover sealing mechanism 4 for gluing, and the specific positions of the gluing nozzles can be set according to the specific gluing positions.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A paper box package forming apparatus, comprising:

a continuous feeding device, including a paperboard stacking frame, an adsorption mechanism and a roll extrusion conveying mechanism, wherein the paperboard stacking frame comprises a bottom frame, a back frame and side columns, the bottom frame is connected to the back frame at a right angle, the side columns are connected to the bottom frame and the back frame, the back frame is arranged obliquely, the back frame comprises a hollow frame and a block rod for blocking a paperboard from pulling out from a back side, and the block rod is arranged in an upper portion of the hollow frame; the adsorption mechanism is positioned on the back side of the back frame and comprises adsorption discs, an adjustable shelf and a pushing cylinder, a lower end of the adjustable shelf is hinged with a lower end of the back frame, the pushing cylinder is configured for pushing the adjustable shelf, and the adsorption discs are fixed to an upper portion of the adjustable shelf in a direction facing towards the back frame and is positioned below the block rod; the roll extrusion conveying mechanism is arranged above the back side of the back frame and comprises a lower conveyor belt and an upper roll extrusion belt, the upper roll extrusion belt is positioned above the lower conveyor belt, a conveying channel for conveying the paperboard is formed between the upper roll extrusion belt and the lower conveyor belt, and the lower conveyor belt is longer than the upper roll extrusion belt and forms a guide section for guiding the paperboard to enter the conveying channel at a position adjacent to the back frame;

a box folding device, including a machine frame, a downward-pressing inner punch, a box folding outer mold and a pushing mechanism, wherein the downward-pressing inner punch is positioned above the box folding outer mold, and the downward-pressing inner punch is connected to the machine frame through a downward-pressing cylinder; the box folding outer mold comprises a front baffle, side baffles, back baffles, corner block rods and cover supporting rods, the front baffle, the side baffles and the back baffles are arranged in a rectangle side edge manner, a top edge height of the front baffle and the back baffles is higher than a top edge height of the side baffles, the corner block rods are each arranged at an opposite angle position of a corner formed by one of the back baffles and a respective one of the side baffles, a height of the corner block rods is higher than the top edge height of the back baffles, the cover supporting rods are arranged in parallel on two sides of the front baffle, a height of the cover supporting rods is higher than the top edge height of the front baffle, and the front baffle, the side baffles and the back baffles are connected to the machine frame through first horizontal cylinders; the pushing mechanism comprises a supporting table, pushing chains and pushing plates, the pushing plates are vertically connected to the pushing chains, the pushing chains are arranged on two sides of the supporting table, a height of the pushing chains is lower than a table top of the supporting table, and top edges of the pushing plates are higher than the table top of the supporting table; and a cover sealing mechanism, including a bearing table and a downward-pressing and attaching mechanism, wherein the bearing table and the downward-pressing and attaching mechanism are connected to the machine frame, an in-place baffle is arranged on the bearing table, the downward-pressing and attaching mechanism is arranged above the bearing table and comprises a downward-pressing driving mechanism, a top-pressing plate, side-pressing plates and overturning cylinders, the top-pressing plate is connected to the machine frame through the downward-pressing driving mechanism, the top-pressing plate is rectangular, four side edges of a periphery of the top-pressing plate are hinged with the side-pressing plates, the overturning cylinders are fixedly connected to a top surface of the top-pressing plate, and the overturning cylinders drive the side-pressing plates to overturn downwards;

wherein the roll extrusion conveying mechanism is positioned on one side of the downward-pressing inner punch and the box folding outer mold, the paperboard output by the roll extrusion conveying mechanism, wherein the paperboard enters a space between the downward-pressing inner punch and the box folding outer mold, and a paper box is pushed to the bearing table by the pushing mechanism.

2. The paper box package forming apparatus according to claim 1, wherein rollers are arranged on the block rod.

3. The paper box package forming apparatus according to claim 2, wherein a guide rod is arranged in a lower portion of the hollow frame, and guide rollers are arranged on the guide rod.

4. The paper box package forming apparatus according to claim 1, wherein a plurality of guide posts are arranged on the bottom frame, and a sliding press plate is arranged on the guide posts.

5. The paper box package forming apparatus according to claim 1, wherein the corner block rods are each positioned at a position of an included angle within 20° of a bisector of angle formed by one of the back baffles and the respective one of the side baffles.

6. The paper box package forming apparatus according to claim 1, wherein a horizontal contact portion is arranged on each of the corner block rods, and an angle of less than 90° is formed between a vertical projection of the horizontal contact portion and a vertical projection of the back baffle or the side baffle.

7. The paper box package forming apparatus according to claim 1, wherein guide plates are arranged above the box folding outer mold, and the guide plates are connected to the machine frame through third horizontal cylinders.

8. The paper box package forming apparatus according to claim 1, wherein downward-hanging roll extrusion wheels are arranged on side edges of the top-pressing plate, and notches are arranged on the side-pressing plates and configured for enabling the roll extrusion wheels to pass therethrough.

9. The paper box package forming apparatus according to claim 1, wherein a bottom surface of the top-pressing plate is connected to a second press plate in a hanging manner through springs, and a vertical projection of the second press plate is within a vertical projection range of the top-pressing plate.

* * * * *